United States Patent [19]

Matthaei

[11] 4,095,697

[45] Jun. 20, 1978

[54] STAND FOR HOLDING PIPETTE CANS

[75] Inventor: Heinrich Matthaei, Gottingen, Germany

[73] Assignee: Max-Planck-Gesellschaft zur Forderung der Wissenschaften e.V., Gottingen, Germany

[21] Appl. No.: 717,212

[22] Filed: Aug. 24, 1976

[30] Foreign Application Priority Data

Aug. 26, 1975 Germany ..... 7527001[U]

[51] Int. Cl.[2] ..... A47G 29/00

[52] U.S. Cl. ..... 211/71; 211/134; 248/146

[58] Field of Search ..... 211/71–76, 211/186, 189, 134, 13, 126, 128, 133, 135, 85, 4, 8, 9, 10, 11; 312/216, 215, 218, 242, 244; 248/127, 146, 150, 152, 174, 176

[56] References Cited

U.S. PATENT DOCUMENTS

| | | | |
|---|---|---|---|
| D. 142,352 | 9/1945 | Gutz et al. | 211/60 G |
| 1,928,594 | 9/1933 | Kearney | 312/244 X |
| 2,111,846 | 3/1938 | Durham | 211/186 |
| 2,261,122 | 11/1941 | Martinus | 211/71 |
| 2,547,486 | 4/1951 | Page | 312/218 X |
| 2,616,566 | 11/1952 | Levy | 211/4 |

FOREIGN PATENT DOCUMENTS

| | | | |
|---|---|---|---|
| 688,689 | 6/1964 | Canada | 211/134 |
| 670,136 | 4/1952 | United Kingdom | 211/74 |
| 10,343 of | 1901 | United Kingdom | 211/71 |

*Primary Examiner*—Roy D. Frazier
*Assistant Examiner*—Terrell P. Lewis
*Attorney, Agent, or Firm*—Flynn & Frishauf

[57] ABSTRACT

A stand, for holding cans for pipettes used in laboratory work, provides for support of a plurality of cans in a horizontally and vertically spaced arrangement. The stand is portably and the cans, while readily removably from the stand, may be transported while in the stand. The cans are held at a slight angle to the horizontal when the stand is in use to provide ready access to the pipettes.

10 Claims, 3 Drawing Figures

STAND FOR HOLDING PIPETTE CANS

The present invention concerns a stand for holding several pipette cans containing each a number of pipettes, these cans may be positioned in, and can be taken out from compartments in the holder.

It is known and customary to keep pipettes needed in the laboratory for various purposes of microbiology, hygienics, cell biology, virology etc. in closed cans; these were placed so far into e.g. circular openings of wooden boxes fixed on the working bench. When empty, pipette cans are refilled with pipettes and sterilized by heat (mostly overnight). As the cans must be transported to the places of refilling and heat sterilizing, this way of handling is rather inefficient, moreover, it may easily lead to breakage of pipettes. More important, there is the danger of eventually forgetting to sterilize single pipette cans.

It is an object to provide a pipette can holder which makes refilling and sterilizing of the cans simpler and safer. The pipette can holder should keep available at any time — space savingly and in a convenient position — all the sizes of pipettes required in a working station — nowadays mostly in a laminar flow hood; moreover, it should be well portable.

SUBJECT MATTER OF THE PRESENT INVENTION:

The pipette stand comprises a metal frame structure, preferably made of solid metal plates which has a solid metal base plate sufficiently heavy to pevent the stand from being tippy. The frame structure has upright elements and top and bottom cross elements, to form an essentially rectangular frame. Additionally, intermediate transverse extending spacers connect the upright elements to subdivide space between the bottom and top cross elements — preferably plates — into a plurality of mutually spaced compartments in which the spacing between the intermediate transverse spaces is just slightly larger than the outer dimension of the pipette cans to permit fitting of the pipette cans into the compartments, to project therefrom, while mutually spacing the cans from ech other by the width of the spacer elements. The spacer elements are so located in the uprights that the compartments have a downwardly, rearwardly sloping bottom, so that the pipette cans will be placed at a slight slant — preferably in the order of about 13°.

The innovation has the principal advantage that the cans may normally remain in their holder throughout all the steps in the working process, including transport and sterilization. Thereby handling is easier and more time saving than before, and the danger of breaking pipettes is reduced. Moreover, the compact and relatively small holder makes it possible to save space on the lab bench.

Figure 1:
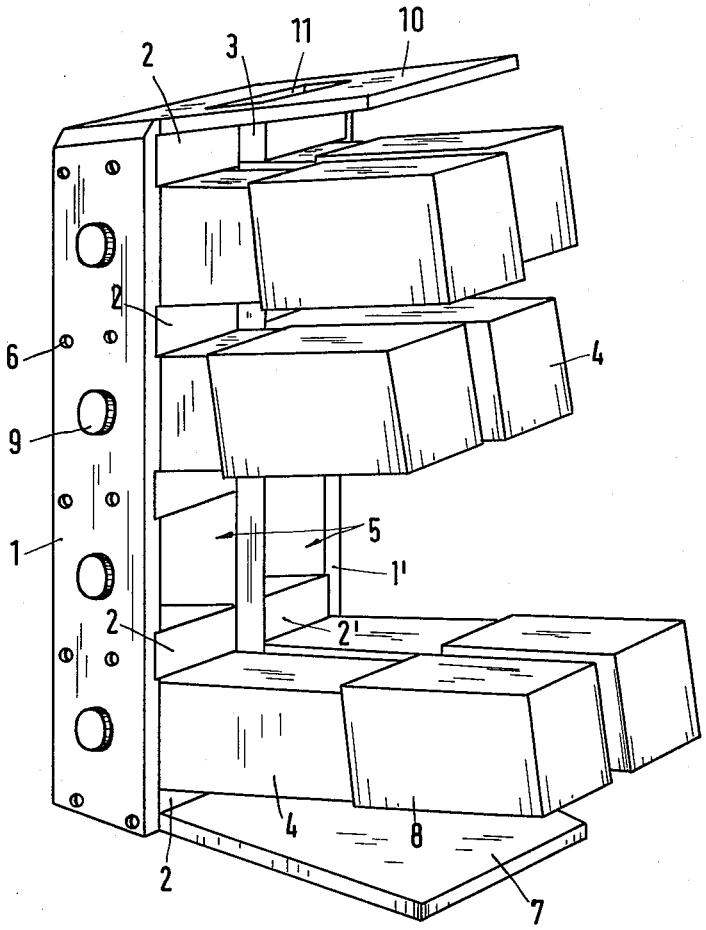
Figure 2B:
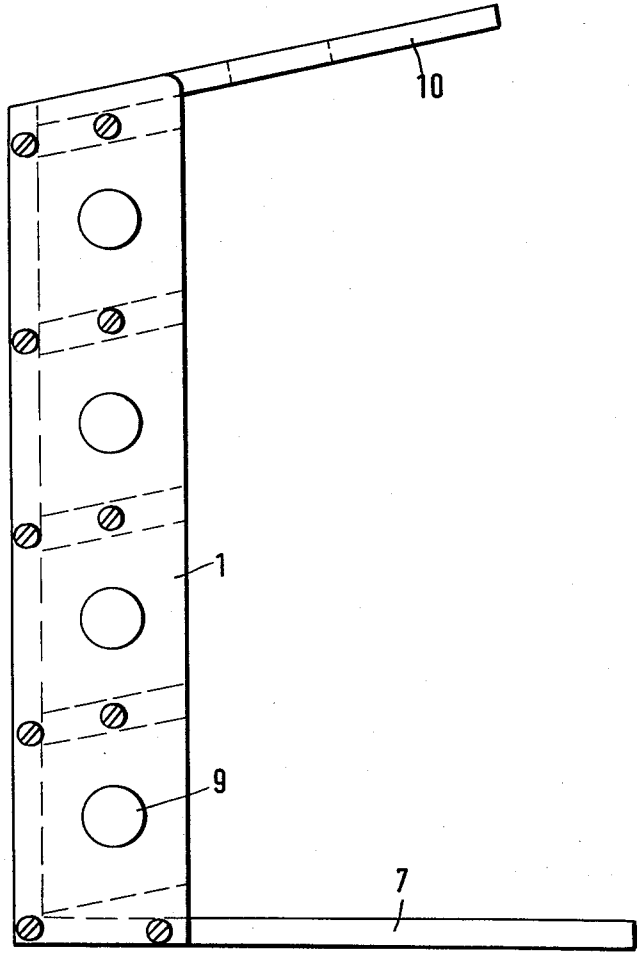
Figure 2A:
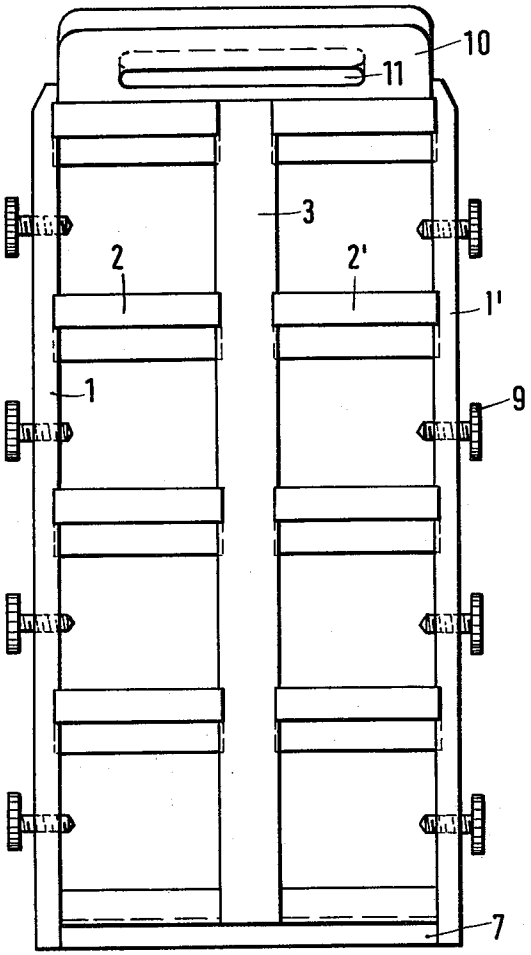

Drawings, illustrating a preferred example:

FIG. 1 shows a perspective side and front view,

FIG. 2*a* shows diagrammatic views of front, and

FIG. 2*b* of the side.

The stand serving as a holder for pipette cans is reversibly placed on the lab bench. It consists of solid hard aluminum plates held together by screws. Two plates 1,1' form the vertical walls, between which more or less horizontal plates 2,2' and another vertical wall in the middle 3 form receptacles for the cans 4, in our example eight, which may be of different length. On the back, the receptacles 5 are closed by a screw-attached plate (not visible in the drawing). The receptacles 5, two of which are shown empty, have the same rectangular or quadratic form as the cross section of the pipette cans 4; they are only a little wider so that the cans may be placed therein easily. The horizontal plates 2,2' may be inserted into the slots of the vertical walls 1 and 3 and fixed in this position by screws; it results in a stable, compact and relatively heavy stand which even under the weight of the pipette cans is prevented from tipping over by a screw-attached massive base plate 7. An upper plate 10 serves as a handle and has a fingers grip opening 11. The horizontal plates 2,2' are at an angle deviating from the horizontal plane, which ensures that the tips of the pipettes inside the cans 4 touch the bottoms of the cans; a suitable angle is about 13°. The upper ends of the cans are likewise located in one plane which is advantageous since the sterility of other pipettes, when taking out one pipette is not impaired. The pipette can 4 put into the receptacle will hold by its own weight. For arresting a can 4, each receptacle has a screw hole drilled and threaded through the side wall 1 or 1', positioned in the middle between the next upper and lower horizontal plates 2 or 2', respectively; a screw 9 is threaded to pass against the outer side wall of the corresponding can. With the pipette cans arrested in this way, the whole stand may be carried away after use (usually in the evening) for refilling and for sterilizing in a heating over, where pipettes become sterile at e.g. 250° C (overnight). As mentioned already, cans 4 normally remain fixed in the holder during all steps of the working process.

Every can contains a number of pipettes (not shown), which may be taken out after removal of its cover 8. Due to its weight, the holder described, stands firmly enough to allow opening of the cans with one hand - without holding the stand with the other hand. In special cases, of course, the holder may be removably fixed to a lab bench.

The embodiment may be modified in order to minimize disturbances to either horizontoal or vertical air streams in laminar flow devices, e.g. by modifying the handle and by special modifications of the geometrical arrangement, so as to avoid shielding effects, and air turbulence between and below the cans. Metal holders for cylindrical pipette cans to be protected should be designed to minimize upsetting laminar flow of air. The cans are then held in round-shaped receptacles, designed e.g. as pieces of metal tube, as circular openings in vertical metal plates of the stand or the like.

I claim:

1. A pipette can holder stand to receive and removably hold a plurality of pipette cans, each adapted to hold the plurality of pipettes and permit ready removal of individual pipettes from said cans in the holder, comprising a portable metal frame structure including upright elements (1, 1', 3);

top and bottom cross elements (7, 10) connecting the upright elements adjacent their terminal ends;

and intermediate transversely extending spacers (2, 2') connecting said upright elements transversely to subdivide the space defined between the upright elements and the top and bottom cross elements into a plurality of mutually spaced compartments (5), the spacing between the intermediate transverse spaces being just slightly larger than the outer dimension of the pipette cans to permit fitting the cans into said compartments and project therefrom, while mutually spacing the cans from each other by the width of said spacers;

wherein the bottom cross element (7) comprises an essentially flat plate-like base element projecting frontally from the upright elements (1, 1', 3) and having a size which inhibits tipping of the stand when loaded with pipette cans located in the compartments and projecting frontally therefrom;

wherein said intermediate transversely extending spacers are located on the upright in position such that the bottom of each compartment slopes downwardly from front to back to retain pipette cans inserted into said compartments by gravity;

and projecting means (9) extending transversely of the compartments and forming stop elements adapted for engagement with said pipette cans to located said pipette cans in the respective compartments.

2. A pipette can holder stand according to claim 1 wherein the slope angle is about 13°.

3. A pipette can holder stand according to claim 1 wherein the bottom cross element (7) is a solid metal plate.

4. A pipette can holder stand accoring to claim 1 wherein the bottom cross element (7) is a solid metal plate.

5. A pipette can holder stand according to claim 1 wherein the top cross element (10) is an apertured, frontally projecting plate forming a carrying handle.

6. A pipette can holder stand according to claim 1 wherein the top cross element (10) is inclined downwardly and rearwardly at essentially the same angle as the bottom of said compartments.

7. A pipette can holder stand according to claim 6 wherein the bottom cross element (7) is a solid metal plate.

8. A pipette can holder stand according to claim 1 wherein the stop means comprise screws (9) laterally passing through at least some of the uprights (1, 1') and into the space defined by said compartments to permit locking pipette cans therein.

9. A pipette can holder stand according to claim 1 wherein the top cross element is an apertured frontally projecting plate forming a carrying handle and positioned at an angle of inclination, downwardly and rearwardly, of essentially the same angle as the bottom of said compartments.

10. A pipette can holder stand according to claim 9, wherein the bottom cross element (7) is a solid metal plate.

* * * * *